US006067962A

United States Patent [19]

Bartley et al.

[11] Patent Number: 6,067,962

[45] Date of Patent: May 30, 2000

[54] ENGINE HAVING A HIGH PRESSURE HYDRAULIC SYSTEM AND LOW PRESSURE LUBRICATING SYSTEM

[75] Inventors: Bradley E. Bartley, Manito; James R. Blass, Bloomington; Dennis H. Gibson, Chillicothe, all of Ill.

[73] Assignee: Caterpillar Inc., Peoria, Ill.

[21] Appl. No.: 09/189,108

[22] Filed: Nov. 10, 1998

Related U.S. Application Data

[63] Continuation-in-part of application No. 08/990,584, Dec. 15, 1997.

[51] Int. Cl.[7] ..... F02M 37/04

[52] U.S. Cl. ..... 123/446; 123/196 R

[58] Field of Search ..... 123/446, 447, 123/196 R, 196 CP, 90.12–90.13; 60/484, 494, 420, 422

[56] References Cited

U.S. PATENT DOCUMENTS

| | | | |
|---|---|---|---|
| 3,186,344 | 6/1965 | Hogeman . | |
| 3,975,908 | 8/1976 | Smith et al. . | |
| 4,373,490 | 2/1983 | Kimata et al. . | |
| 4,435,133 | 3/1984 | Mewendyk . | |
| 4,476,836 | 10/1984 | Enomoto et al. . | |
| 4,541,385 | 9/1985 | Eheim et al. . | |
| 4,628,881 | 12/1986 | Beck et al. . | |
| 4,730,580 | 3/1988 | Matsushita . | |
| 5,168,703 | 12/1992 | Tobias . | |
| 5,174,115 | 12/1992 | Jacobson et al. . | |
| 5,245,970 | 9/1993 | Iwaszkiewicz et al. . | |
| 5,460,133 | 10/1995 | Perr et al. . | |
| 5,485,820 | 1/1996 | Iwaszkiewicz . | |
| 5,540,203 | 7/1996 | Foulkes et al. | 123/447 |
| 5,615,553 | 4/1997 | Lourigan | 60/422 |
| 5,697,343 | 12/1997 | Isozumi et al. . | |

*Primary Examiner*—Thomas N. Moulis
*Attorney, Agent, or Firm*—Michael B. McNeil

[57] ABSTRACT

An engine includes a high pressure hydraulic system having a high pressure pump and at least one hydraulically-actuated device attached to an engine housing. A low pressure engine lubricating system is attached to the engine housing and includes a circulation conduit fluidly connected to an outlet from the high pressure pump.

20 Claims, 1 Drawing Sheet

ENGINE HAVING A HIGH PRESSURE HYDRAULIC SYSTEM AND LOW PRESSURE LUBRICATING SYSTEM

RELATION TO OTHER PATENT APPLICATION

The present application is a continuation-in-part of co-pending patent application Ser. No. 08/990,584, filed Dec. 15, 1997 with the same title as above.

The Government has the rights in this invention pursuant to Contract No. DE-FC05-97OR22605-S-90,700 awarded by the U.S. Department of Energy.

TECHNICAL FIELD

The present invention relates generally to engines that includes hydraulic devices, and more particularly to an engine that utilizes a low pressure oil lubricating system and a high pressure hydraulically-actuated device system.

BACKGROUND ART

Engines have long utilized a variety of devices that draw power directly or indirectly from the engine for their operation. Among these devices are fuel injectors, gas intake and exhaust valves, exhaust brakes, etc. In the past, these devices were typically actuated by a cam that is driven directly by the engine. In order to improve engine performance across its operating spectrum, there has been a trend in the industry toward the adoption of electronically controlled hydraulic devices. An example of this trend is the hydraulically-actuated electronically-controlled unit injector (HEUI) system utilized by Caterpillar, Inc., of Peoria, Ill., in their diesel engines.

In a typically HEUI system, a high pressure pump maintains a common rail containing engine lubricating oil at a relatively high pressure that is sufficient to actuate the hydraulic fuel injectors. The high pressure pump draws oil from a reservoir that is filled by the engines' low pressure oil lubrication circulating pump. After the high pressure oil is utilized by the fuel injectors, it is circulated back to the oil pan. Thus, a portion of the oil moved by the low pressure oil lubrication pump is circulated through the engine for lubrication, and another portion is pumped into the reservoir that supplies the high pressure pump.

In this current system, the high pressure pump is attached to the outside of the engine, and thus any noise emitted from the pump is easily detectable. In addition, the reservoir that supplies the high pressure pump is above the engine's oil pan. This can result in excessive engine cranking from a cold start while the low pressure pump provides enough oil to the reservoir for the high pressure hydraulic system to achieve the relatively high pressures necessary for its operation. Not only does the high pressure pump tend to emit noise, but its location on the outside of the engine creates a protrusion that undermines the ability to position the engine in a confined space. Finally, because the current system uses both a low and high pressure pump, there is generally a higher probability of failure than if the system could accomplish its tasks with a single pump.

The present invention is directed to these and other problems associated with engines that utilize hydraulically actuated devices.

DISCLOSURE OF THE INVENTION

In one embodiment, an engine includes an engine housing. A high pressure hydraulic system has a high pressure pump, and at least one hydraulically-actuated device attached to the engine housing. A low pressure engine lubricating system is also attached to the engine housing and includes a circulation conduit fluidly connected to an outlet from the high pressure pump.

BEST MODE FOR CARRYING OUT THE INVENTION

Figure 1:
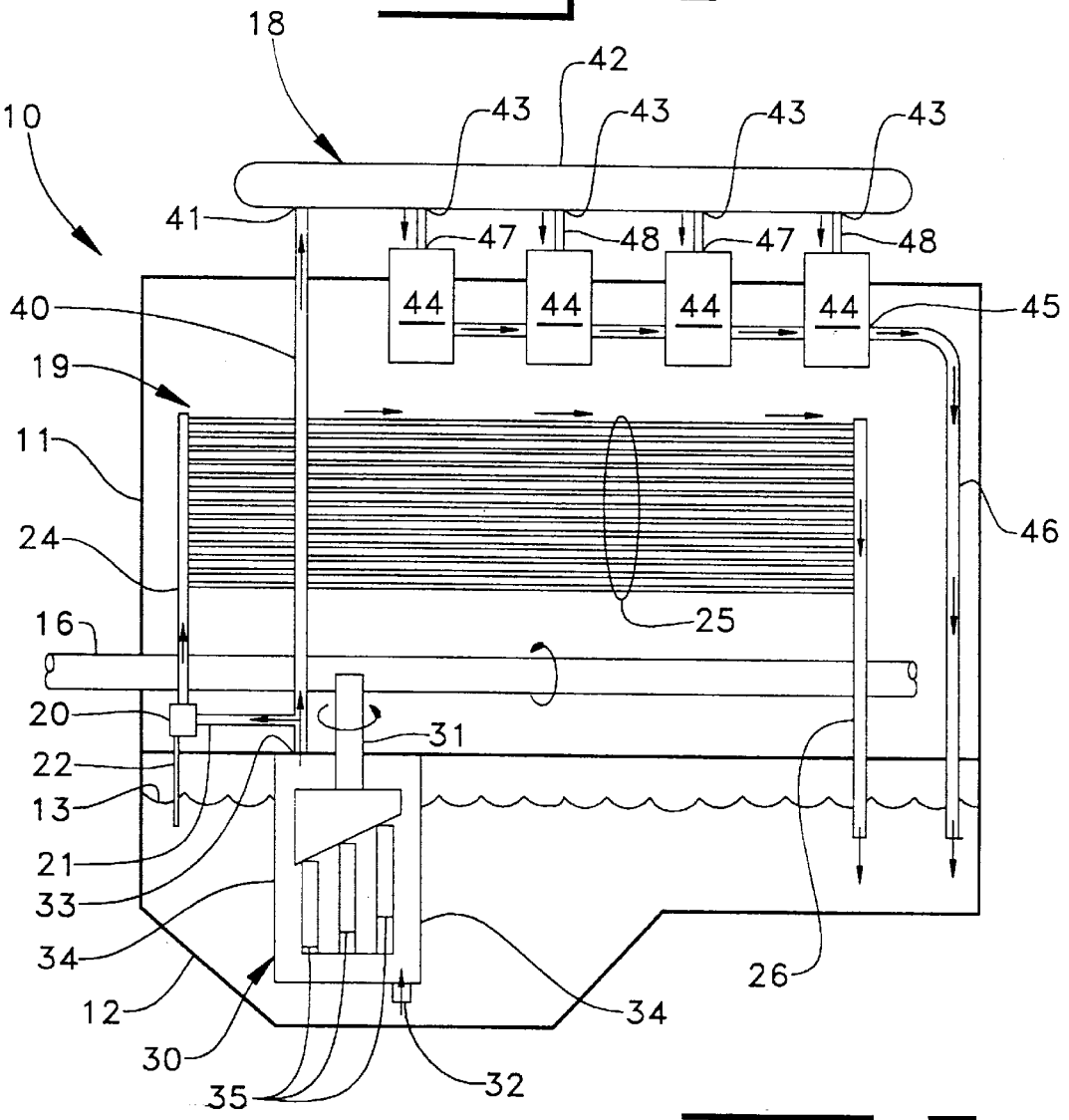
FIG. 1 is a schematic illustration of an engine according to a preferred embodiment of the present invention.

Referring now to FIG. 1, an engine 10 includes engine casing 11. An oil pan 12, which is a portion of engine casing 11, is filled with an amount of lubricating oil up to a level therein. Engine 10 includes a low pressure lubricating system 19 and a high pressure hydraulic system 18 that both use lubricating oil originating from oil pan 12 as their respective working fluids. Unlike some previous engine systems, both high pressure hydraulic system 18 and low pressure lubricating system 19 share a common high pressure pump 30 that draws lubricating oil directly from oil pan 12.

High pressure pump 30 includes a pump shaft 31 that is preferably driven directly by the drive shaft 16 of engine 10. In order to conserve the space occupied by engine 10 and reduce pump noise, the pump housing 34 is preferably at least partially submerged in oil 13 within oil pan 12. In this way, pump 30 preferably includes an inlet 32 that draws lubricating oil directly from oil pan 12. High pressure pump 30 is preferably an axial piston type pump having a plurality of reciprocating pistons 35, as known in the art. When lubricating oil leaves outlet 33 of high pressure pump 30, a portion enters the lubricating oil system 19 by entering upstream circulation conduit 21, and another portion enters the high pressure hydraulic system 18 by branching into high pressure supply pipe 40.

Figure 2:
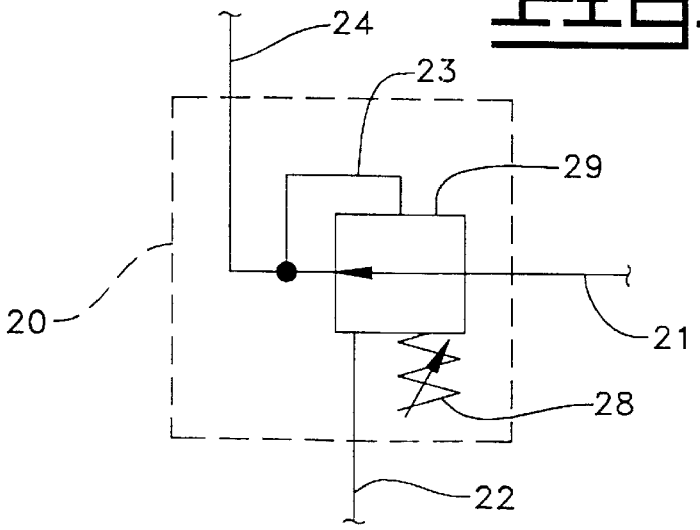
FIG. 2 is a schematic illustration of a pressure reducing valve according to one aspect of the present invention.

Referring now, in addition to FIG. 2, upstream circulation conduit 21 is connected to a pressure reducing valve 20 that reduces the pressure in the downstream circulation conduit 24 of lubricating system 19 to a pressure typical of low pressure oil lubricating systems. Preferably, pressure reducing valve 20 is a three-way valve that includes a valve member 29 that is biased toward a position that opens upstream circulation conduit 21 to downstream circulation conduit 24. However, valve member 29 is moveable to a lower position against biasing means 28 to channel a portion of the fluid in upstream circulation conduit 21 directly back to oil pan 12 via over-pressure return line 22 when the pressure tap line 23 senses that pressure in downstream circulation conduit 24 has exceeded a predetermined maximum pressure. In general, the flow area through valve 20 between upstream conduit 21 and downstream conduit 24 is preferably a function of pressure in downstream conduit 24. After leaving circulation conduit 24, the lubricating oil passes through a plurality of lubrication passages 25 that maintain the various moving parts within engine 10 properly lubricated in a conventional manner. The oil then reconverges in a return conduit 26, and is routed back to oil pan 12 for recirculation.

Operating in parallel to the engines lubricating system 18 is the high pressure hydraulic system 19 that utilizes the lubricating oil 13 as a hydraulic medium in actuating a plurality of hydraulic devices 44. Hydraulic devices 44 could include but are not limited to hydraulically-actuated fuel injectors, hydraulically-actuated intake and exhaust valves, hydraulically-actuated exhaust brakes, etc. Pressurized oil leaves pump 30 at outlet 33 and travels along high pressure supply pipe 40 to an inlet 41 of a high pressure common rail 42. High pressure rail 42 has a plurality of outlets 43, each of which is connected to a respective branch passage 48. The inlets 47 of hydraulic devices 44 are each connected to a separate branch passage 48. The drain ports 45 of the hydraulic devices empty the used oil into a common return pipe 46 that returns the oil to oil pan 12 for recirculation.

INDUSTRIAL APPLICABILITY

Those skilled in the art will appreciate that the present invention achieves noise reduction by at least partially submerging the high pressure pump 30 in an amount of oil so that the surrounding oil dampens the noise produced during the normal operation of the high pressure pump 30. Additional noise attenuation is achieved by the enclosure of the high pressure pump in the oil pan 12. In many prior art hydraulic systems, the high pressure pump was typically attached to the outside of the engine, and thus it radiated undesirable noise away from the engine.

By positioning the inlet of the high pressure pump near the bottom of the oil pan, the hydraulic system 18 is always exposed to a ready supply of oil, especially when the engine is undergoing a cold start condition. In the past, the inlet of the high pressure pump was exposed to a secondary reservoir located at a position well above the oil pan, was supplied by the same low pressure pump that circulated the lubricating oil through the engine. As a consequence, the engine could sometimes be required to crank excessively before the engine could start since the secondary reservoir would have to be substantially filled before the hydraulic system could have a sufficient amount of oil to draw upon for the necessary operation of the hydraulic fuel injectors. The present invention overcomes this perceived irritation by always exposing the inlet of the high pressure pump to oil in the oil pan.

The present invention also aids in streamlining engine packaging since only one pump is utilized for both the hydraulic and oil lubricating systems. In addition, the present invention eliminates the need for a separate oil reservoir for the high pressure pump, by positioning the single high pressure pump within the engine casing as opposed to being attached to the outside surface of the engine as in some previous designs. Thus, the engine incorporating the present invention should not only perform better than their prior art counterparts, but should also have the ability to occupy less space and operate more quietly than their prior art counterparts. This combination of features permits engines according to the present invention to be positioned in more confined spaces than might be otherwise be possible with prior art engine systems.

The above description is intended for illustrative purposes only, and is not intended to limit the scope of the present invention in any way. For instance, while the low and high pressure systems in the illustrated embodiment are shown to be completely parallel, those skilled in the art will appreciate that other variations might be possible. For instance, the medium pressure used oil leaving the hydraulic devices could be harnessed to push oil through the lubricating passages of the engine before being returned to the oil pan. Thus, various modifications could be made to the illustrated embodiment without departing from the intended spirit and scope of the present invention, which is defined in terms of the claims set forth below.

We claim:

1. An engine comprising:

an engine housing;

a high pressure hydraulic system having a high pressure pump and at least one hydraulically actuated device attached to said engine housing; and a low pressure engine lubricating system attached to said engine housing and including a circulation conduit fluidly connected to an outlet from said high pressure pump.

2. The engine of claim 1 wherein said high pressure hydraulic system includes a high pressure supply pipe attached to said outlet from said high pressure pump;

said circulation conduit is attached to said high pressure supply pipe; and a pressure reducing valve positioned in said circulation conduit.

3. The engine of claim 2 wherein a flow area through said pressure reducing valve is a function of fluid pressure in said circulation conduit downstream from said pressure reducing valve.

4. The engine of claim 2 further including an over pressure return line extending between said pressure reducing valve and an oil pan.

5. The engine of claim 1 further including a pressure reducing valve positioned in said circulation conduit; and an over pressure return line extending between said pressure reducing valve and an oil pan.

6. The engine of claim 1 wherein said engine housing includes an oil pan with an amount of oil therein; and said high pressure pump includes an inlet fluidly connected to said oil pan.

7. The engine of claim 6 wherein said high pressure pump is at least partially submerged in said amount of oil.

8. The engine of claim 1 wherein said hydraulic system includes a high pressure rail and a plurality of hydraulic devices attached to said engine housing;

an inlet to said high pressure rail being connected to an outlet from said high pressure pump; and an outlet from said high pressure rail being connected to an inlet of each of said plurality of hydraulic devices.

9. The engine of claim 8 wherein a portion of said plurality of hydraulic devices are fuel injectors.

10. The engine of claim 1 wherein said high pressure pump has an inlet that opens directly into said amount of oil in an oil pan attached to said engine housing.

11. An engine comprising:

an engine housing;

a high pressure hydraulic system attached to said engine housing and including a high pressure pump, high pressure rail and a plurality of hydraulic devices, and an inlet to said high pressure rail being connected to an outlet from said high pressure pump, and an outlet from said high pressure rail being connected to an inlet of each of said plurality of hydraulic devices; and a low pressure engine lubricating system attached to said engine housing and including a circulation conduit fluidly connected to said outlet from said high pressure pump.

12. The engine of claim 11 further including a pressure reducing valve positioned in said circulation conduit; and an over pressure return line extending between said pressure reducing valve and an oil pan.

13. The engine of claim 12 wherein said engine housing includes an oil pan with an amount of oil therein; and said high pressure pump includes an inlet fluidly connected to said oil pan.

14. The engine of claim 13 wherein said high pressure pump is at least partially submerged in said amount of oil.

15. The engine of claim 14 wherein a portion of said plurality of hydraulic devices are fuel injectors.

16. The engine of claim 15 wherein said high pressure rail is connected to said outlet from said high pressure pump via a high pressure supply pipe; and said circulation conduit is attached to said high pressure supply pipe.

17. The engine of claim 16 wherein a flow area through said pressure reducing valve is a function of fluid pressure in said circulation conduit downstream from said pressure reducing valve.

18. An engine comprising:

an engine housing having an oil pan with an amount of oil therein;

a high pressure hydraulic system attached to said engine housing, and having at least one hydraulically actuated device and a high pressure pump at least partially submerged in said amount of oil;

a low pressure engine lubricating system attached to said engine housing and including a circulation conduit fluidly connected to an outlet from said high pressure pump; and a pressure reducing valve positioned in said circulation conduit.

19. The engine of claim 18 wherein a portion of said plurality of hydraulic devices are fuel injectors.

20. The engine of claim 19 wherein a flow area through said pressure reducing valve is a function of fluid pressure in said circulation conduit downstream from said pressure reducing valve; and an over pressure return line extending between said pressure reducing valve and said oil pan.

* * * * *